US009138038B2

(12) United States Patent
deGrood et al.

(10) Patent No.: US 9,138,038 B2
(45) Date of Patent: Sep. 22, 2015

(54) HAIR STYLING APPARATUS HAVING HAIR-PROTECTION FUNCTION

(75) Inventors: Michael John deGrood, Madison, WI (US); Gary Lee McMurray, Verona, WI (US)

(73) Assignee: Spectrum Brands, Inc., Middleton, WI (US)

( * ) Notice: Subject to any disclaimer, the term of this patent is extended or adjusted under 35 U.S.C. 154(b) by 256 days.

(21) Appl. No.: 13/112,533

(22) Filed: May 20, 2011

(65) Prior Publication Data

US 2012/0291797 A1 Nov. 22, 2012

(51) Int. Cl.

| | |
|---|---|
| ***A45D 1/28*** | (2006.01) |
| ***A45D 1/04*** | (2006.01) |
| *A45D 2/00* | (2006.01) |
| *A45D 1/00* | (2006.01) |

(52) U.S. Cl.

CPC .. *A45D 1/28* (2013.01); *A45D 1/04* (2013.01); *A45D 2/001* (2013.01); *A45D 2001/004* (2013.01)

(58) Field of Classification Search

CPC ..... A45D 1/28; A45D 4/08; A45D 6/20
USPC ..... 132/220, 269, 211, 271, 272, 223–236, 132/117, 118; 219/221–22, 225, 227–231, 219/240–241, 490, 509; 392/384, 403–406
See application file for complete search history.

(56) References Cited

U.S. PATENT DOCUMENTS

| | | | | |
|---|---|---|---|---|
| 4,602,143 A | | 7/1986 | Mack et al. | |
| 4,877,042 A | * | 10/1989 | Downey | 132/212 |
| 5,349,160 A | * | 9/1994 | Hazan et al. | 219/250 |
| 5,391,859 A | * | 2/1995 | Hazan et al. | 219/250 |
| 5,857,379 A | * | 1/1999 | Lulofs et al. | 73/73 |
| 6,026,821 A | * | 2/2000 | Last | 132/200 |
| 7,356,943 B2 | | 4/2008 | Behbehani | |

(Continued)

FOREIGN PATENT DOCUMENTS

| | | |
|---|---|---|
| DE | 3112384 A1 | 11/1982 |
| DE | 3434416 A1 | 3/1985 |

(Continued)

OTHER PUBLICATIONS

European Search Report dated Jan. 17, 2011, Patent Application No. 09009006.9-2313/2272391, 9 pages.

(Continued)

*Primary Examiner* — Todd Manahan
*Assistant Examiner* — Brianne Kalach
(74) *Attorney, Agent, or Firm* — Armstrong Teasdale LLP

(57) ABSTRACT

A hair styling apparatus includes a hair-heating device for applying heat to hair. The hair-heating device has a moisture-temperature setting and a dry-temperature setting less than moisture-temperature setting. A moisture sensor detects a moisture-indicating parameter of the hair, and generates a moisture-indicating signal indicative of whether the hair is at or below a predetermined moisture threshold level. A control circuit adjusts the temperature of the hair-heating device from the moisture-temperature setting to the dry-temperature setting in response to the moisture sensor generating a moisture-indicating signal indicative of the hair being at or below the predetermined moisture threshold level. The hair-heating device is active in the dry-temperature setting.

22 Claims, 12 Drawing Sheets

(56) References Cited

U.S. PATENT DOCUMENTS

| | | | | |
|---|---|---|---|---|
| 2008/0007273 | A1 | 1/2008 | Sherman et al. | |
| 2011/0253164 | A1 * | 10/2011 | Morgandi et al. | 132/211 |

FOREIGN PATENT DOCUMENTS

| | | | |
|---|---|---|---|
| EP | 0176003 | A1 | 4/1986 |
| EP | 0679350 | A1 | 11/1995 |
| EP | 1400187 | A1 | 3/2004 |
| EP | 2272391 | A1 | 1/2011 |
| JP | 3000008 | A | 1/1991 |
| WO | 9926512 | A1 | 6/1999 |
| WO | 2010016072 | A1 | 2/2010 |
| WO | 2011004340 | A2 | 1/2011 |

OTHER PUBLICATIONS

Evans & Parker, "A Statistical Analysis of Hair Breakage, II—Repeated Grooming experiments", J. Cosmet. Sci., 61, pp. 439-455, Nov./Dec. 2010.

Erratum to "Evans & Parker, 'A Statistical Analysis of Hair Breakage, II—Repeated Grooming experiments', J. Cosmet. Sci., 61, pp. 439-455, Nov./Dec. 2010", J. Cosmet. Sci., 62, 359, 1 page, May/Jun. 2011.

Partial European Search Report for 12168408.8-1258, dated Oct. 9, 2012, 6 pages.

Extended European Search Report for Application No. 12168408.8 dated Mar. 22, 2013, Rovcal, Inc., 13 pages.

* cited by examiner

HAIR STYLING APPARATUS HAVING HAIR-PROTECTION FUNCTION

FIELD OF THE DISCLOSURE

The present disclosure relates generally to hair styling apparatus, and more particularly to a hair styling apparatus capable of adjusting the temperature of a heating member of the hair styling apparatus based, at least in part, on an amount of moisture detected in hair being styled.

BACKGROUND

Many different types of hair styling apparatus are available for use in styling hair. For example, a hair styling apparatus may be used for straightening, curling, waving and/or otherwise achieving a desired look of the hair. Some such hair styling apparatus have the capability of applying heat to the hair, and in particular, to provide one or more heated surfaces against which the hair to be styled is contacted during styling. Such hair styling apparatus (e.g., flat irons, curling irons, curlers, etc.) apply high levels of heat directly to the hair. However, applying excessive heat to the hair over a prolonged period of time may damage the hair. For example, excessive heat may damage the cuticle layer that covers the shaft of the hair strand and protects hair fibers. Excessive heat may also break down the chemical structure of hair, which may lead to a decrease in the elasticity of the hair and even result in breakage.

SUMMARY

In one aspect, a hair styling apparatus generally comprises a hair-heating device for applying heat to hair. The hair-heating device is operable in a moisture-temperature setting and a dry-temperature setting less than moisture-temperature setting. A moisture sensor is adapted to detect a moisture-indicating parameter of the hair, and generate a moisture-indicating signal indicative of whether the hair is at or below a predetermined moisture threshold level. A control circuit in operative communication with the hair-heating device and the moisture sensor is configured to adjust the temperature of the hair-heating device from the moisture-temperature setting to the dry-temperature setting in response to the moisture sensor generating a moisture-indicating signal indicative of the hair being at or below the predetermined moisture threshold level. The hair-heating device is active in the dry-temperature setting.

In another aspect, a method of styling hair using a hair styling apparatus generally comprises heating a hair-heating device of the hair styling apparatus to a moisture-temperature setting. Heat is applied to the hair using the hair-heating device. A moisture sensor and a control circuit of the hair styling apparatus is used to determine that the hair is at or below a predetermined moisture threshold level. The temperature of hair-heating device, using the control circuit, is decreased from the moisture-temperature setting to a dry-temperature setting in response to determining that the hair is at or below the predetermined moisture threshold level. The hair-heating device is active in the dry-temperature setting.

In yet another aspect, a hair styling apparatus generally comprises first and second arms secured to one another for selective movement toward one another to configure the hair styling apparatus between an open position and a closed position. A heating member assembly on the first arm includes a thermally conductive heating member having an imaginary axis and a hair-heating surface in generally opposing relationship with the second arm. The heating member defines a recess in the hair-heating surface extending generally axially along the heating member. A heating unit in thermal contact with the heating member is adapted for selectively heating the heating member to a temperature sufficient to evaporate moisture in hair when the hair is disposed between the hair-heating surface and the second arm and when the hair styling apparatus is configured in the closed position. A moisture sensor is adapted to produce a moisture-indicating signal indicative of whether hair disposed between the hair-heating surface and the second arm is at or below a predetermined moisture threshold level. The moisture sensor includes an electrode assembly disposed in the recess of the first arm. The electrode assembly includes a pair of spaced apart electrodes extending axially along the heating member. A control circuit in electrical communication with the moisture sensor is configured to receive the moisture-indicating signal from the moisture sensor and determine whether the hair is at or below the predetermined moisture threshold level using the moisture-indicating signal.

BRIEF DESCRIPTION OF THE DRAWINGS

Corresponding reference characters indicate corresponding parts throughout the drawings.

DETAILED DESCRIPTION OF THE DRAWINGS

Figure 1:
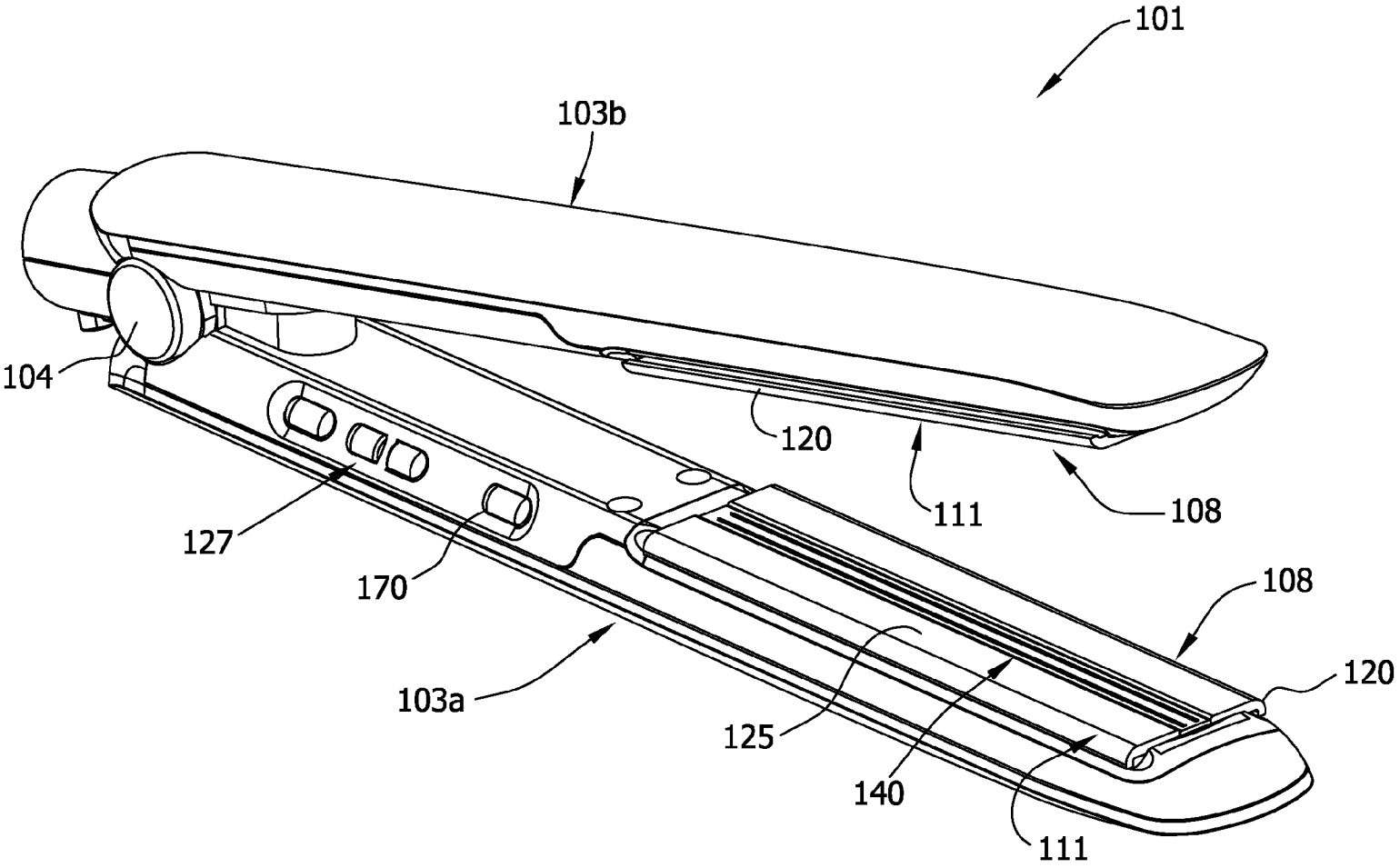
FIG. 1 is a perspective view of one embodiment of a hair styling apparatus in an open position thereof.
Figure 2:
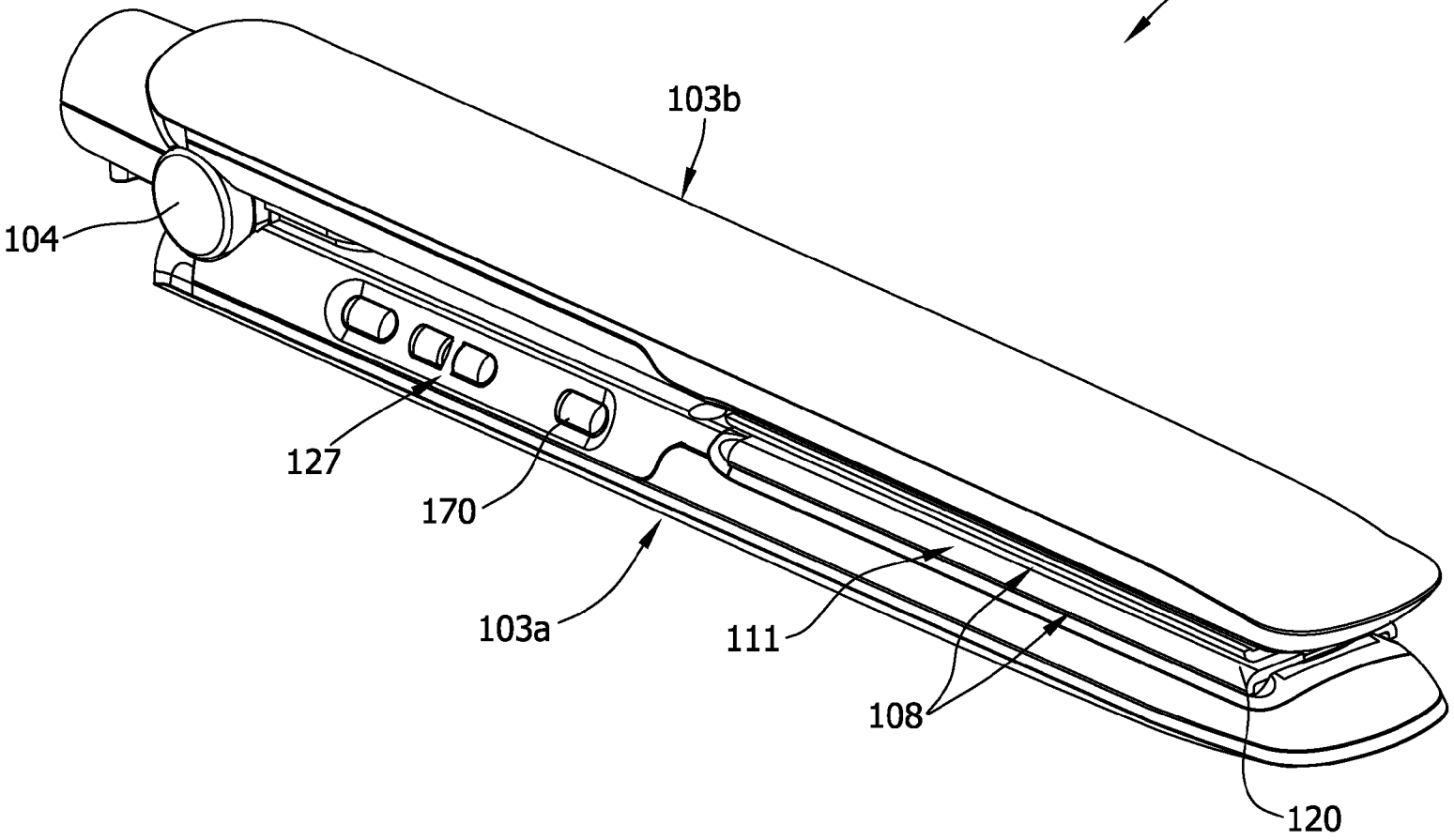
FIG. 2 is a perspective view of the hair styling apparatus of FIG. 1 in a closed position thereof.

Referring now to the drawings and in particular to FIGS. 1 and 2, one embodiment of a hair styling apparatus is generally designated 101. The illustrated hair styling apparatus 101 is generally in the form of a flat iron (also referred to as a hair straightener), which can be used to straighten and/or curl hair. As explained in more detail below, the hair styling apparatus 101 includes a hair-protection function that is intended to protect hair from heat damage when a portion of a user's hair being styled by the apparatus is detected as being at or below a predetermined moisture threshold level. In one example, the predetermined moisture threshold level—as detected by a moisture sensor, which is described in more detail below—may be about 5%. It is contemplated that the hair styling apparatus 101 may be of a different type, other than a flat iron, such as a curling iron, blow dryer, or other suitable type of hair styling apparatus that is adapted to heat hair during styling.

The hair styling apparatus 101 of the illustrated embodiment is generally elongate with opposite longitudinal ends and has first and second arms (lower and upper arms as illustrated in FIGS. 1 and 2), generally indicated at 103*a* and 103*b*, respectively, held in assembly with each other by a suitable pivot connection 104 at one of the longitudinal ends of the hair styling apparatus. The first and second arms 103*a*, 103*b* are thus moveable relative to one another and about a pivot axis of the pivot connection 104 between an open position (FIG. 1) of the hair styling apparatus 101 and a closed position (FIG. 2) thereof. A biasing member, such as a compression spring (not shown), may be suitably positioned between the first and second arms 103*a*, 103*b* adjacent to the pivot connection 104. In particular, the spring is seated within opposed spring seats formed on each arm to urge the arms toward the open position of the hair styling apparatus 101. The hair styling apparatus 101 may be of other configurations without departing from the scope of the present invention.

Figure 3:
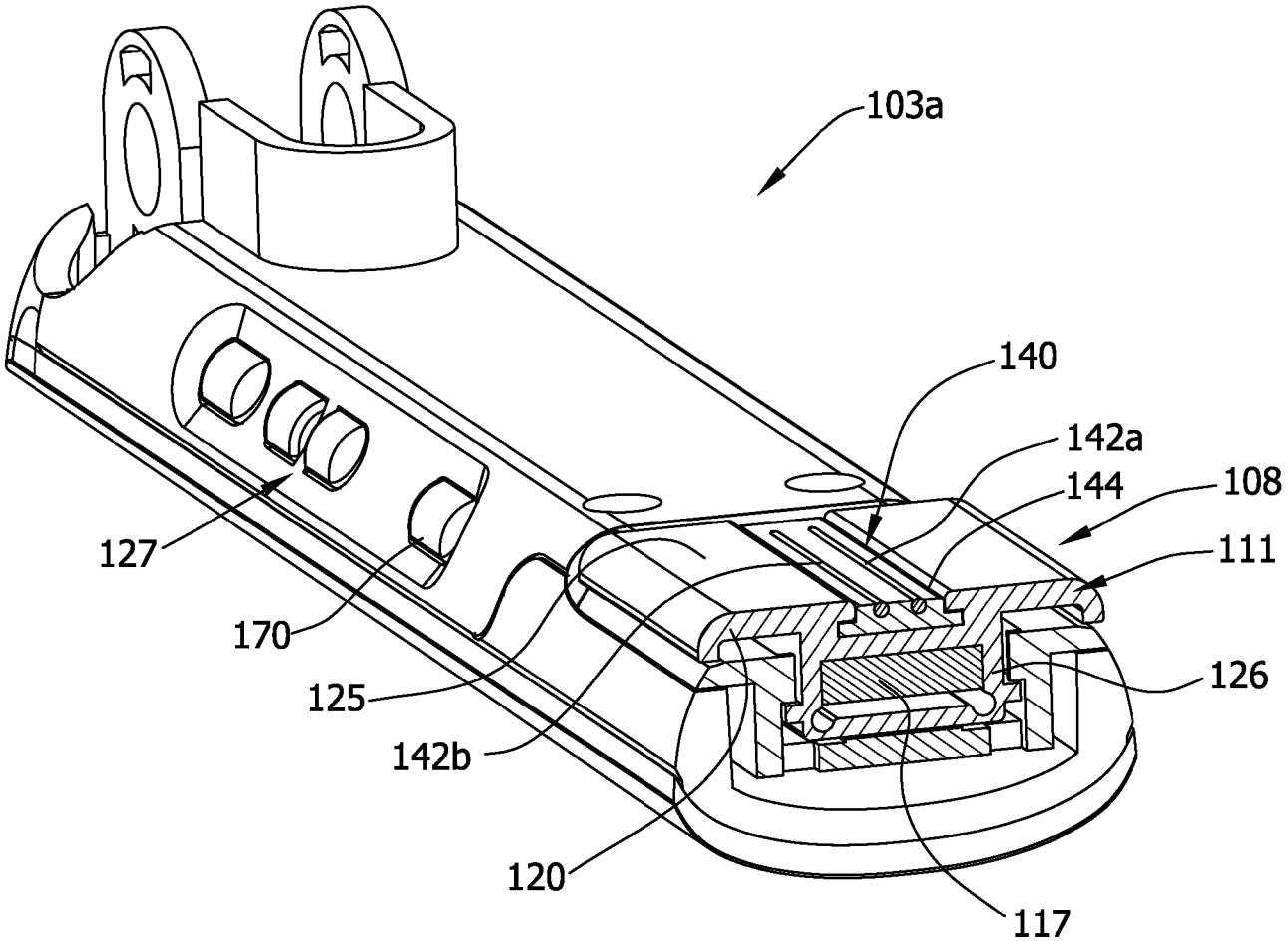
FIG. 3 is an enlarged, cross-sectional perspective view of a first arm of the hair styling apparatus.
Figure 4:
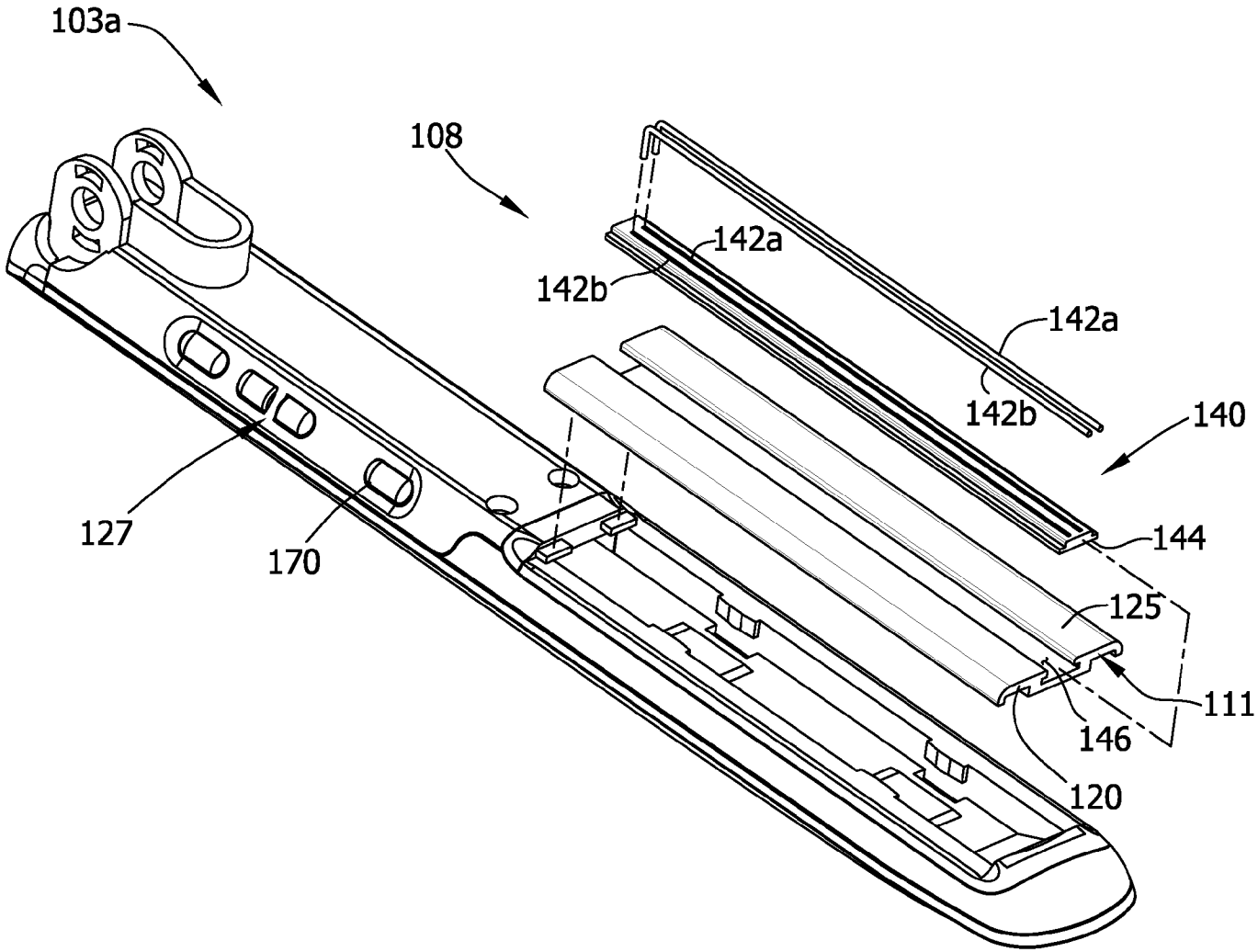
FIG. 4 is an enlarged, exploded perspective view of the first arm of the hair styling apparatus.
Figure 5:
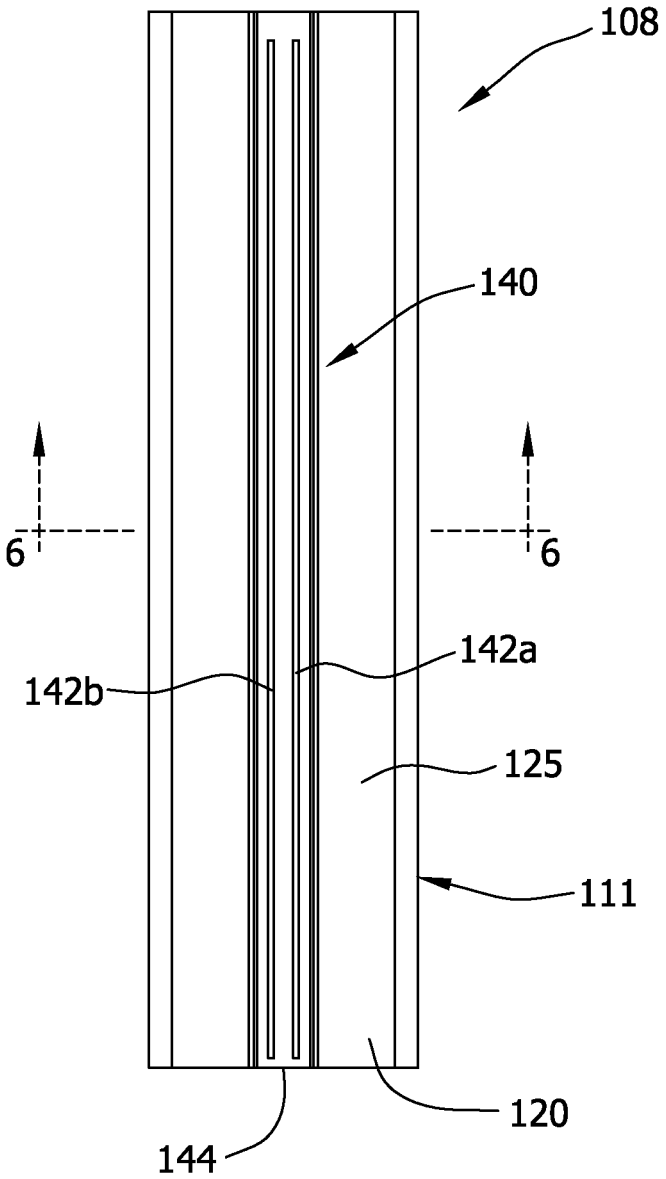
FIG. 5 is a top plan view of a heating member assembly of the first arm of the hair styling apparatus.
Figure 8:
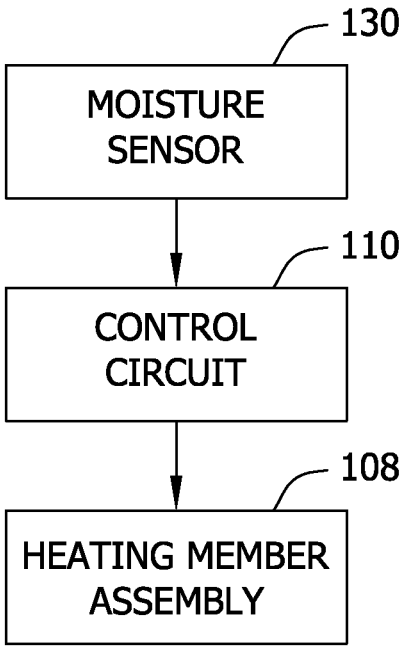
FIG. 8 is a block diagram depicting one example of a communication system for implementing a hair-protection function of the hair styling apparatus.

As seen best in FIGS. 3 and 4, each of the first and second arms 103*a*, 103*b* includes a heating member assembly, generally indicated at 108 (broadly, a hair-heating device), electrically connected to a control circuit 110 (illustrated schematically in FIG. 8) housed within the hair styling apparatus 101 (e.g., housed within the first arm 103*a*). For purposes of this disclosure, only the heating member assembly 108 of the first arm 103*a* is illustrated and described in detail with the understanding that such disclosure may apply equally to the heating member assembly of the second arm 103*b*. The heating member assembly 108 includes a thermally conductive heating member, generally indicated at 111, in thermal contact with a heating unit 117. The heating member 111 of the illustrated embodiment has an upper rectangular plate portion 120 with a hair-heating surface 125, and a lower chamber portion 126, below the plate portion, in which the heating unit 117 is housed. The heating member 111 may be constructed of suitable thermally conductive material, such as but not limited to, aluminum and ceramic. The heating unit 117 suitably comprises one or more heaters, such as electrical resistance heaters (e.g., PTC heating units), electrically connected to the control circuit 110 via suitable wiring (not shown). The heating member 111 and/or the heating unit 117 may be of other configurations without departing from the scope of the present invention.

The heating members 111 of the respective heating member assemblies 108 of the first and second arms 103*a*, 103*b* are sufficiently located longitudinally on the respective arms so that in the closed position of the hair styling apparatus 101 the hair-heating surfaces 125 sandwich hair therebetween. Heat from the hair-heating surfaces 125 is applied to the hair in the closed position of the hair styling apparatus 101. In the open position of the hair styling apparatus 101, the hair-facing surfaces 125 of the heating members 111 are spaced apart from one another a sufficient distance to allow the introduction of hair between the hair-facing surfaces.

The control circuit 110 is programmed or configured to, among other functions, control the temperature of heating member 111 by regulating the heat output of the heating unit 117. The control circuit 110 may include one or more microcontrollers, one or more microprocessors, or other suitable components for regulating the heat output of the heating unit 117 and performing other functions or operations of the hair styling apparatus 101, including but not limited to, the hair-protection function. A temperature sensing unit (not shown), such as a thermistor, is in thermal contact with the heating member 111 and electrically connected to the control circuit 110. The temperature sensing unit sends a temperature-indicating signal, indicative of the temperature of the heating member 111, to the control circuit 110. The control circuit 110 is programmed or configured to regulate the heating unit 117 in response to the temperature-indicating signal.

In one suitable embodiment, the hair styling apparatus 101 is adapted to allow a user to select a moisture-temperature setting from a finite number of moisture-temperature settings, to which the heating members 111 are heated for styling hair. For example, the hair styling apparatus 101 may include one or more temperature controls (e.g., button(s), or switch(es), or a touchscreen), generally indicated at 127, to facilitate selection of the moisture-temperature settings. The moisture-temperature controls 127 communicate with the control circuit 110, and the control circuit regulates the temperature of the heating member 111 in response to signals received from the moisture-temperature controls. As a non-limiting example, the hair styling apparatus 101 may include the following selectable moisture-temperature settings: 230° C., 210° C., 190° C., 170° C., and 150° C. The hair styling apparatus 101 may include other moisture-temperature settings without departing from the scope of the present invention.

As set forth above, the hair styling apparatus 101 includes a hair-protection function that is intended to protect hair from heat damage when a portion of a user's hair being styled by the apparatus is detected to be at or below the predetermined moisture threshold level. To this end, the hair styling apparatus 101 includes a moisture sensor, represented schematically in FIG. 9 and generally indicated at 130, for sensing whether the hair between the arms 103*a*, 103*b* of the hair styling apparatus 101 is at or below the predetermined moisture threshold level when the hair styling apparatus is closed. In the illustrated embodiment, the moisture sensor 130 comprises an electrode assembly, generally indicated at 140, and signal conditioning circuitry, illustrated schematically in FIG. 9 and explained in more detail below, for conditioning an analog signal from the electrode assembly.

As seen best in FIGS. 3-6, the electrode assembly 140 is embedded in the heating member 111 of the first arm 103*a*, although the electrode assembly may be secured to the second arm 103*b* without departing from the scope of the present invention. The electrode assembly includes a pair of electrically conductive electrodes 142*a*, 142*b* embedded in a base 144, which is, in turn, embedded in the heating member 111. The electrodes 142*a*, 142*b* may generally be in the form of wires or other elongate structures, and may be formed from stainless steel, chrome-plated base material, gold-plated base material, high content carbon impregnated plastic or silicone, or other electrically conductive material. In one example, the base 144 is electrically non-conductive to substantially electrically insulate the electrodes 142*a*, 142*b* from each other and from the heating member 111. The base 144 may also be thermally non-conductive, although the base may be thermally conductive without departing from the scope of the present invention. The base 144 may be made from Teflon, PPS, silicone, or other suitable, electrically insulating material.

The base 144 is secured within a recess 146 in the hair-heating surface 125 of the heating member 111, and the electrodes 142*a*, 142*b* are secured within respective recesses 148 in the base. The recess 146 has a generally T-shape which is substantially commensurate in shape with the base 144 such that the electrode assembly 140 is held within the recess. The electrode assembly 140 may be inserted into the recess 146 at an open longitudinal end of the recess, and then the base 144 may be slid longitudinally within the recess 146 to position the electrode assembly in the heating member 111. In one example, electrode assembly 140 may be formed by molding the base 144 over the electrodes 142*a*, 142*b*. Other ways of forming the electrode assembly 140 and securing the electrode assembly to the heating member 111 do not depart from the scope of the present invention.

Figure 7:
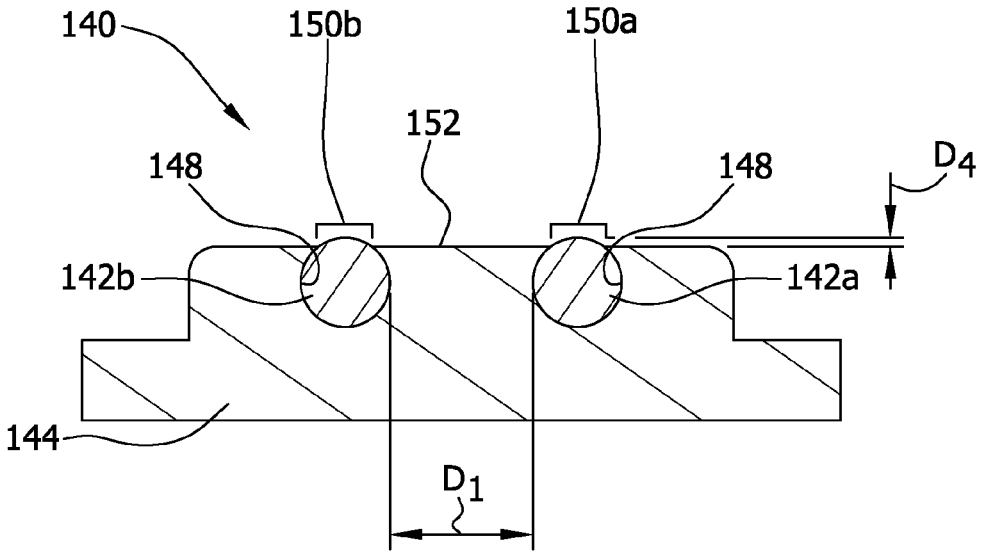
FIG. 7 is an enlarged cross-sectional view of an electrode assembly removed from the heating member assembly of FIG. 6.

The illustrated electrode assembly 140 (i.e., the electrodes 142*a*, 142*b* and the base 144) extends along substantially an entire length of the heating member 111, although the electrode assembly may extend a majority or less than a majority of the length of the heating member. The electrodes 142*a*, 142*b* are substantially parallel to one another and are free from electrical contact with one another. Referring to FIG. 7, the electrodes 142*a*, 142*b* may be spaced apart from one another a distance D1, which may be within a range of about 1.0 mm to about 8.0 mm, and in one example, between about 1.4 mm. The electrodes 142*a*, 142*b* may have other arrangements, without departing from the scope of the present invention. For example, the electrodes 142*a*, 142*b* may extend generally transversely relative to the heating member 111 and the first arm 103*a*. Moreover, there may be more than one set of electrodes 142*a*, 142*b* without departing from the scope of the present invention.

Figure 6:
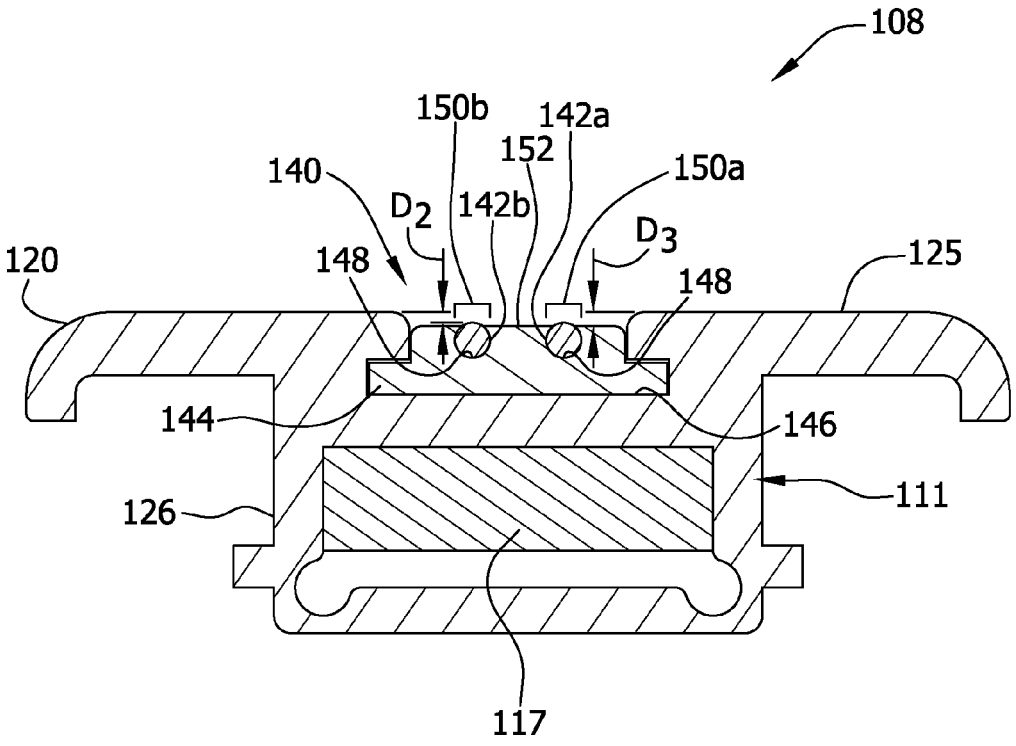
FIG. 6 is an enlarged cross-sectional view of the heating member assembly taken along the line 6-6 in FIG. 5.

Hair-contact peripheral portions 150*a*, 150*b* of the respective electrodes 142*a*, 142*b* make electrical contact with hair during use. Each hair-contact peripheral portion 150*a*, 150*b* extends along substantially the entire length of the embedded portion of the corresponding respective electrode 142*a*, 142*b*. In the illustrated embodiment, each hair-contact peripheral portion 150*a*, 150*b* constitutes less than 50% of the entire periphery of the embedded portion of the corresponding respective electrode 142*a*, 142*b*, and in one example, each hair-contact peripheral portion 150*a*, 150*b* constitutes between about 10% and about 40% of the entire periphery of the embedded portion of the corresponding respective electrode 142*a*, 142*b*. In the illustrated embodiment, the hair-contact portions 150*a*, 150*b* of the respective electrodes 142*a*, 142*b* are disposed a distance D2 below the hair-heating surface 125 (FIG. 6). For example, the distance D2 between the hair-contact peripheral portions 150*a*, 150*b* of the respective electrodes 142*a*, 142*b* and the hair-heating surface 125 may be from about 0.0 mm to about 0.5 mm, and in one example, about 0.3 mm.

The base 144 has a hair-contact surface 152, which may contact hair during use and is disposed a distance D3 below the hair-heating surface 125. For example, the distance D3 between the hair-contact portion 152 of the base 144 and the hair-heating surface 125 may be from about 0.0 mm to about 0.5 mm, and in one example, about 0.4 mm. Moreover, in the illustrated embodiment the hair-contact peripheral portions 150*a*, 150*b* of the respective electrodes 142*a*, 142*b* are disposed in a plane above the hair-contact surface 152 of the base 144. For example, a distance D4 (FIG. 7) between the hair-contact surface 152 and the hair-contact peripheral portions 150*a*, 150*b* of the respective electrodes 142*a*, 142*b* may be from about 0.0 mm to about 0.5 mm, and in one example about 0.1 mm. The base 144 and the electrodes 142*a*, 142*b* may have other configurations without departing from the scope of the present invention.

The moisture sensor 130 is adapted to detect a moisture-indicating parameter of the hair being styled by the hair styling apparatus 101 and to generate a moisture-indicating signal that is generally indicative of whether the hair is at or below the predetermined moisture threshold level. In the illustrated embodiment, the moisture sensor 130 is adapted to detect the impedance of the hair disposed between and in electrical contact with the electrodes 142*a*, 142*b* when the hair is disposed between the heating members 111 of the hair styling apparatus 101. The impedance of the hair generally corresponds to an amount of moisture in the hair. In general, when the hair is moist or wet, the impedance of the hair is low, and the impedance of the hair increases as the hair loses moisture. It is understood that in other embodiments the moisture sensor may be used to detect other moisture-indicating parameters of the hair, such as capacitance or infrared emittance, without departing from the scope of the present invention.

Figure 9:
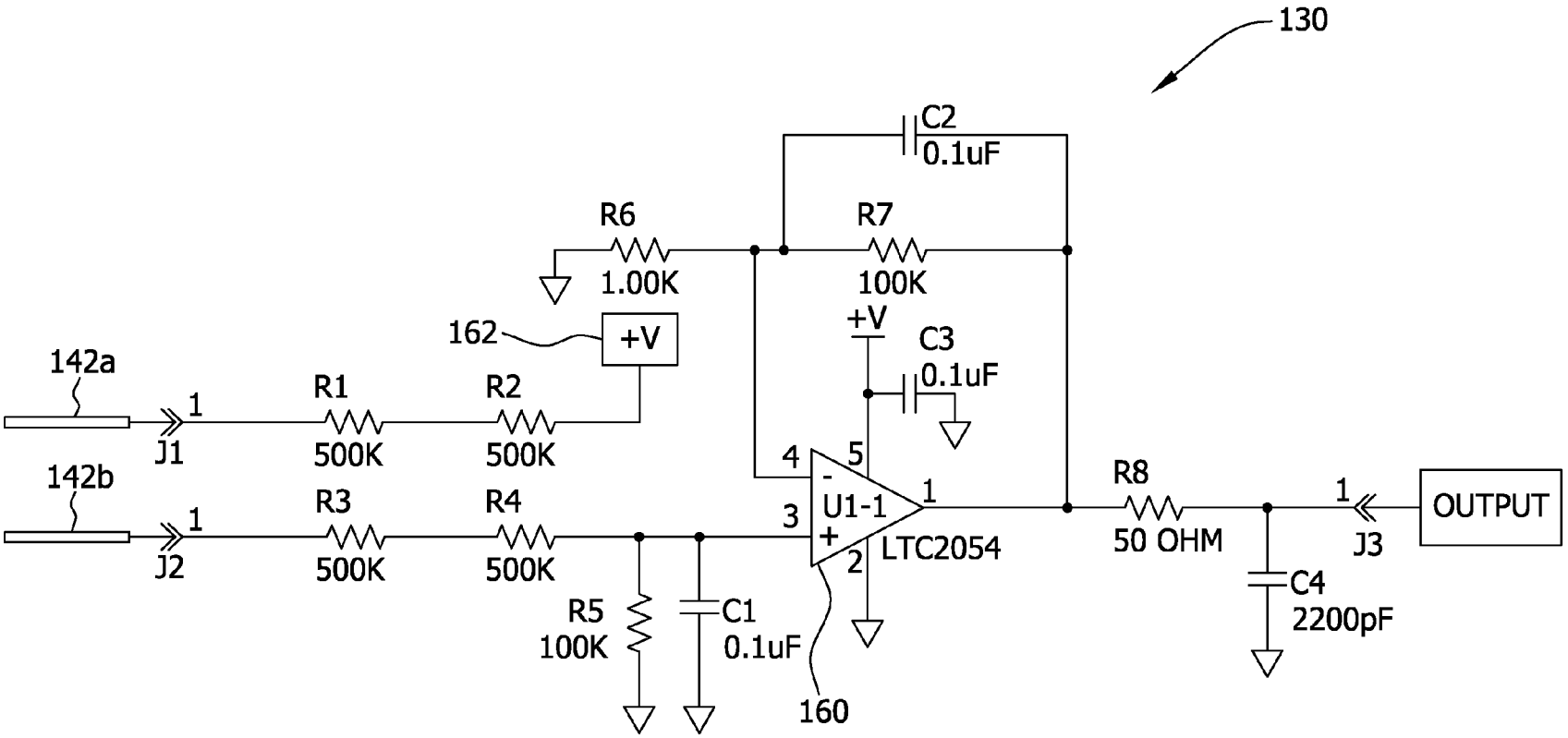
FIG. 9 is a circuit diagram depicting one example of a moisture sensor of the hair styling apparatus.

FIG. 9 is a circuit diagram of one example of the moisture sensor 130 and includes a signal conditioning circuitry of the moisture sensor. As seen in FIG. 9, in this example the moisture sensor 130 includes an operational amplifier (op-amp) 160 configured as a non-inverting amplifier circuit. The electrode 142*a* is electrically connected to a voltage source 162 (e.g., 2.7 to 5 V), and the other electrode 142*b* is electrically connected to one of the inputs of the op-amp 160. The voltage across the electrodes 142*a*, 142*b* serves as an input voltage of the op-amp 160. The op-amp 160 generates an analog output, which indicates whether the hair is at or below the predetermined moisture threshold level, and the analog output is sent to the control circuit 110, before or after being digitized, for determining whether the hair is at or below the predetermined moisture threshold level, as explained in more detail below. The given ratings or values of the electrical components (e.g., resistors, capacitors and voltage source) may be other than shown in the illustrated circuit diagram of the moisture sensor 140 without departing from the scope of the present invention. It is also understood that the moisture sensor may comprise a circuit other than the illustrated non-inverting op-amp circuit, including but not limited to other types of op-amp circuits, without departing from the scope of the present invention.

Referring still to FIG. 9, the moisture sensor 130 (e.g., the non-inverting op-amp circuit of the moisture sensor) includes at least one leakage current protection circuit to inhibit high leakage current. The illustrated moisture sensor 130 includes first and second leakage current protection circuits, each including a pair of high impedance resistors, indicated at R1, and R2, respectively. The first pair of high impedance resistors R1 is connected between the voltage source 162 and the electrode 142*a*. The resistors R1 in the first pair are connected to each other in series. The second pair of high impedance resistors R2 is connected between the electrode 142*b* and the op-amp 160. The resistors R2 in the second pair are connected to each other in series. In one embodiment, each of the resistors R1, R2 in each pair is rated to lower leakage current at 120 V, 60 Hz (standard U.S. and Canada household power supply) to below 500 microamperes. In another embodiment, each of the resistors R1, R2 in each pair is rated to lower leakage current at 240 V, 50 and 60 Hz (household power supply outside the U.S. and Canada) to below 500 microamperes. In the illustrated example, each resistor R1, R2 has an impedance of 500 kΩ. The respective resistors R1, R2 are provided in pairs in each leakage current protection circuit as a failsafe should one of the resistors in the pair be damaged or otherwise fail to suitably lower high leakage current. It is understood that in other embodiments each of the pairs of resistors R1, R2 may be replaced with a single resistor or more than two resistors without departing from the scope of the present invention. It is also understood that the leakage current protection circuit may include other electrical components, other than resistors, or may be configured in other ways to inhibit leakage current from electrocuting a user.

As disclosed above, the moisture-indicating signal is sent to the control circuit 110. In one example, the analog moisture-indicating signal is digitized by an A/D converter (not shown), which may be an on-board A/D converter of the control circuit, in one example. The moisture-indicating signal from the moisture sensor 130 may be further conditioned. The control circuit 110 receives the moisture-indicating signal and is programmed or configured to determine whether the hair is at or below the predetermined moisture threshold level using the digitized moisture-indicating signal. In one example, the moisture sensor 130 outputs a standard voltage (e.g., 5 V) as the analog signal when the sensor detects that the hair is at or below the predetermined moisture threshold level. This analog voltage signal is conditioned (i.e., digitized) by the A/D converter, and the digitized output from the A/D converter is received by the control circuit 110 as the moisture-indicating signal.

The control circuit 110 is programmed or configured to determine whether the digitized moisture-indicating signal is indicative of the hair being at or below the predetermined moisture threshold level. In one embodiment, if the control circuit 110 determines that the hair is at or below the predetermined moisture threshold level, the control circuit is programmed or configured to set the temperature of the heating members 111 to a dry-temperature setting. It is understood that the term "dry-temperature setting" does not necessarily mean that the hair is detected as being dry, although this may be the case, but merely that the hair is detected as being at or below the predetermined moisture threshold level. In one example, in the dry-temperature setting the control circuit 110 regulates the heating unit 117 so that the temperature of heating member 111 is less than or equal to about 210° C., or less than or equal to about 200° C., or less than or equal to about 195° C., or more specifically, less than or equal to about 190° C. As explained in more detail below in the Experimental Example, it was determined that hair, when it is at or below the predetermined moisture threshold level of about 5%, is more prone to damage if it is exposed to temperatures above 190° C., and is substantially more prone to damage if it is exposed to temperature above 210° C. In one example, the dry-temperature setting may be greater than about 75° C., or greater than 80° C., or more specifically, greater than 100° C. In one example, the dry-temperature setting may be from about 160° C. to about 200° C., or from about 165° C. to about 195° C., or from about 170° C. to about 190° C.

In the illustrated embodiment, the hair styling apparatus 101 may be configured to allow a user to disable the hair-protection function. That is, in one embodiment, the hair styling apparatus 101 allows a user to selectively disable and enable the hair-protection function. In the illustrated embodiment, the hair styling apparatus 101 includes a hair-protection control 170 (e.g., a button, or a switch, or a touchscreen) that selectively disables and enables the hair-protection function. In one example, the selected state of the hair-protection function (i.e., enabled or disabled) may be stored in a memory device, such as an EEPROM device (not shown), that is accessible by the control circuit 110. Exemplary steps for the control circuit 110 in response to the hair-protection being enabled or disabled are discussed in more detail below. In one embodiment, the hair-protection function is enabled upon turning on the hair styling apparatus 101, and the hair-protection function must be disabled by the user, if so desired.

Also in the illustrated embodiment, the hair styling apparatus 101 is configured such that the hair-protection function is enabled only when the hair styling apparatus is closed. When the hair-styling apparatus 101 is open, the hair styling apparatus is set to the selected moisture-temperature setting, the selection of which is described above. Thus, during styling, if the moisture sensor 130 detects that the hair is at or below the predetermined moisture threshold level, and the control circuit 110 sets the temperature to the dry-temperature setting, the control circuit will set the heating members 111 to the selected moisture-temperature setting when the hair styling apparatus 101 is opened. In one example, the hair styling apparatus 101 may include a state switch (broadly, an actuator) in communication with the control circuit 110 for indicating that the hair styling apparatus is closed (or open). Exemplary steps for the processor in response to the hair styling apparatus being opened or closed are discussed in more detail below.

Figure 10:
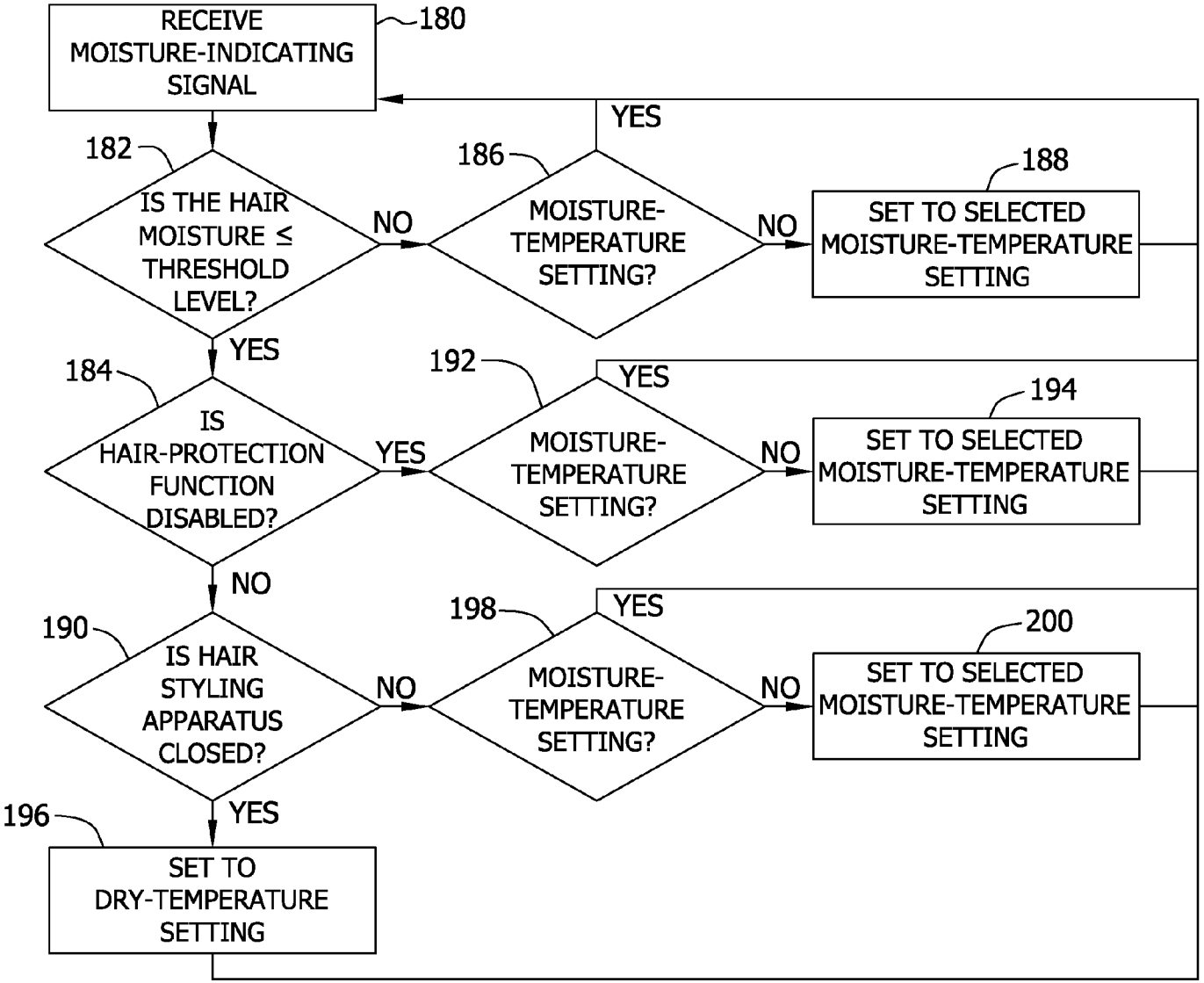
FIG. 10 is a flowchart representing one example of an operation performed by the control circuit of the hair styling apparatus for implementing the hair-protection function.

An exemplary method performed by the control circuit 110 is illustrated graphically by a flow chart in FIG. 10. At step 180, the control circuit 110 receives the moisture-indicating signal from the moisture sensor 140, such as set forth above. At step 182, the control circuit 110 determines if the moisture-indicating signal is indicative of the hair being at or below the predetermined moisture threshold level. For example, the control circuit 110 may use an analog resistance measurement from the moisture sensor 140 to determine if the hair is at or below the predetermined moisture threshold level. If the control circuit 110 determines that the moisture-indicating signal is indicative of hair being at or below the predetermined moisture threshold level, then at step 184 the control circuit determines if the hair-protection function is disabled. If the moisture-indicating signal is not indicative of the hair being at or below the predetermined moisture threshold level, then at step 186 the control circuit 110 determines if the heating members 111 are set to the moisture-temperature setting. If the control circuit 110 determines that the heating members 111 are set to the selected moisture-temperature setting, then the control circuit returns to the step 180 of receiving the moisture-indicating signal. If the control circuit 110 determines that the heating members 111 are not set to the selected moisture-temperature setting, then at step 188 the control circuit sets the heating members to the selected moisture-temperature setting, and then returns to the step 182 of receiving the moisture-indicating signal.

If at the step 184 the control circuit 110 determines that the hair-protection function is not disabled (i.e., the hair-protection function is enabled), then at step 190 the control circuit determines if the hair styling apparatus 101 is closed. If the control circuit 110 determines that the hair styling apparatus 101 is disabled, then at step 192 the control circuit 110 determines if the heating members 111 are set to the selected moisture-temperature setting. If the control circuit 110 determines that the heating members 111 are set to the selected moisture-temperature setting, then the control circuit returns to the step 180 of receiving the moisture-indicating signal. If the control circuit 110 determines that the heating members 111 are not set to the selected moisture-temperature setting, then at step 194 the control circuit 110 sets the heating members to the selected moisture-temperature setting, and then returns to the step 180 of receiving the moisture-indicating signal.

If at step 190 the control circuit 110 determines that the hair styling apparatus 101 is closed, then at step 196, the control circuit sets the heating members 111 to the dry-temperature setting, and after setting the heating members 111 to the dry-temperature setting, the control circuit returns to the step 180 of receiving the moisture-indicating signal. If the control circuit 110 determines that the hair styling apparatus 101 is not closed (i.e., the hair styling apparatus is open), then at step 198 the control circuit 110 determines if the heating members 111 are set to the selected moisture-temperature setting. If the control circuit 110 determines that the heating members 111 are set to the selected moisture-temperature setting, then the control circuit returns to the step 180 of receiving the moisture-indicating signal. If the control circuit 110 determines that the heating members 111 are not set to the selected moisture-temperature setting, then at step 200 the control circuit 110 sets the heating members to the selected moisture-temperature setting, and then returns to the step 180 of receiving the moisture-indicating signal.

Figure 11:
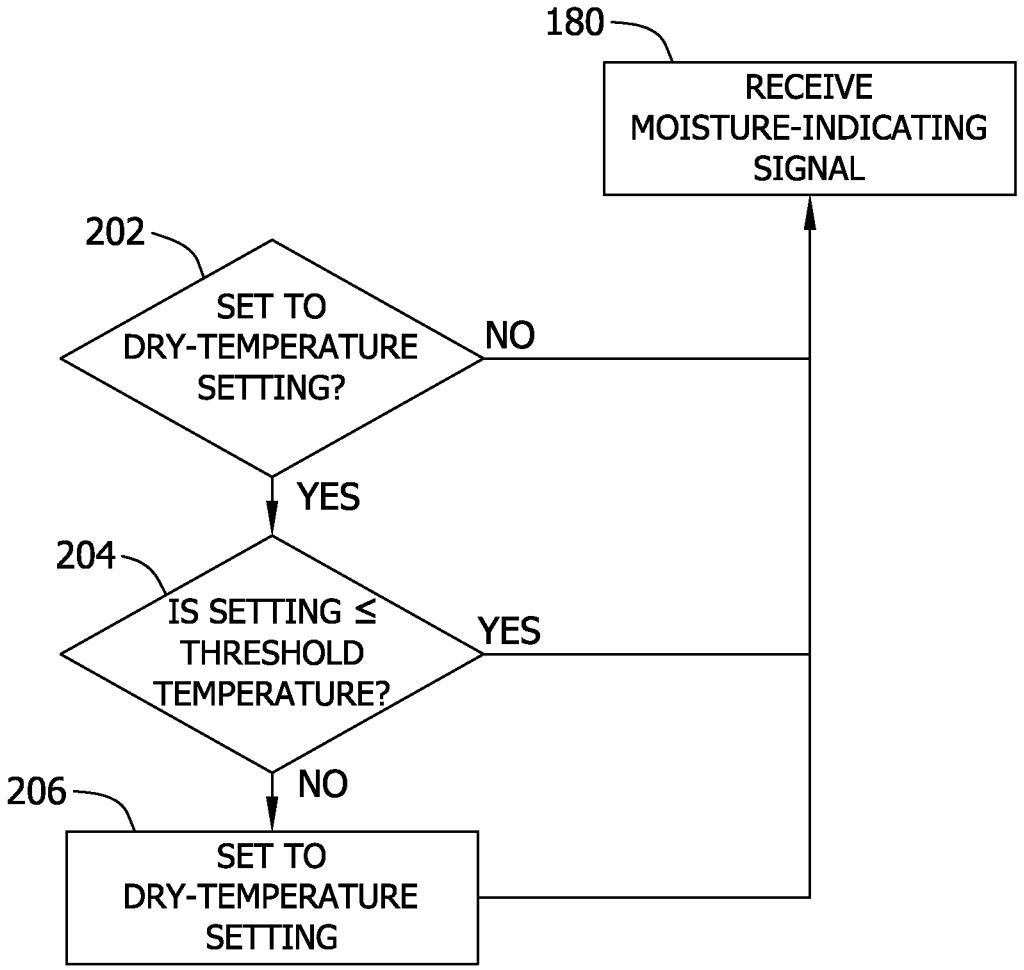
FIG. 11 is a flowchart representing one example of an operation performed by the control circuit of the hair styling apparatus for setting the heating member assembly to a dry-temperature setting.

In one example, at the step 196 the control circuit 110 may be programmed or configured to perform additional steps in setting the hair styling apparatus 101 to the dry-temperature setting. For example, referring to FIG. 11 the control circuit 110 may be configured or programmed to first determine, at step 202, if the heating members 111 are already set to the dry-temperature setting, and if so, the control circuit will proceed to the step 180. If, however, the control circuit 110 determines at step 202 that the heating members 111 are not set to the dry-temperature setting (i.e., the heating members are set to the moisture-temperature setting), then, at step 204, the control circuit determines whether the selected moisture-temperature setting corresponds to a temperature at or below a preselected threshold temperature (e.g., 210° C., or 200° C., or 190° C.). In this example, if the moisture-temperature setting is set to a temperature at or below the preselected threshold temperature, then the control circuit 110 does not change the temperature setting and returns to the step 180 of receiving the moisture-indicating signal. If, however, the control circuit 110 determines that the selected moisture-temperature setting corresponds to a temperature above the preselected threshold temperature, then the control circuit proceeds to the step 206 of setting the heating members 111 to the dry-temperature setting. At step 206, the control circuit 110 may set the heating members 111 to the dry-temperature setting by regulating the heating member to the preselected threshold temperature.

Figure 12:
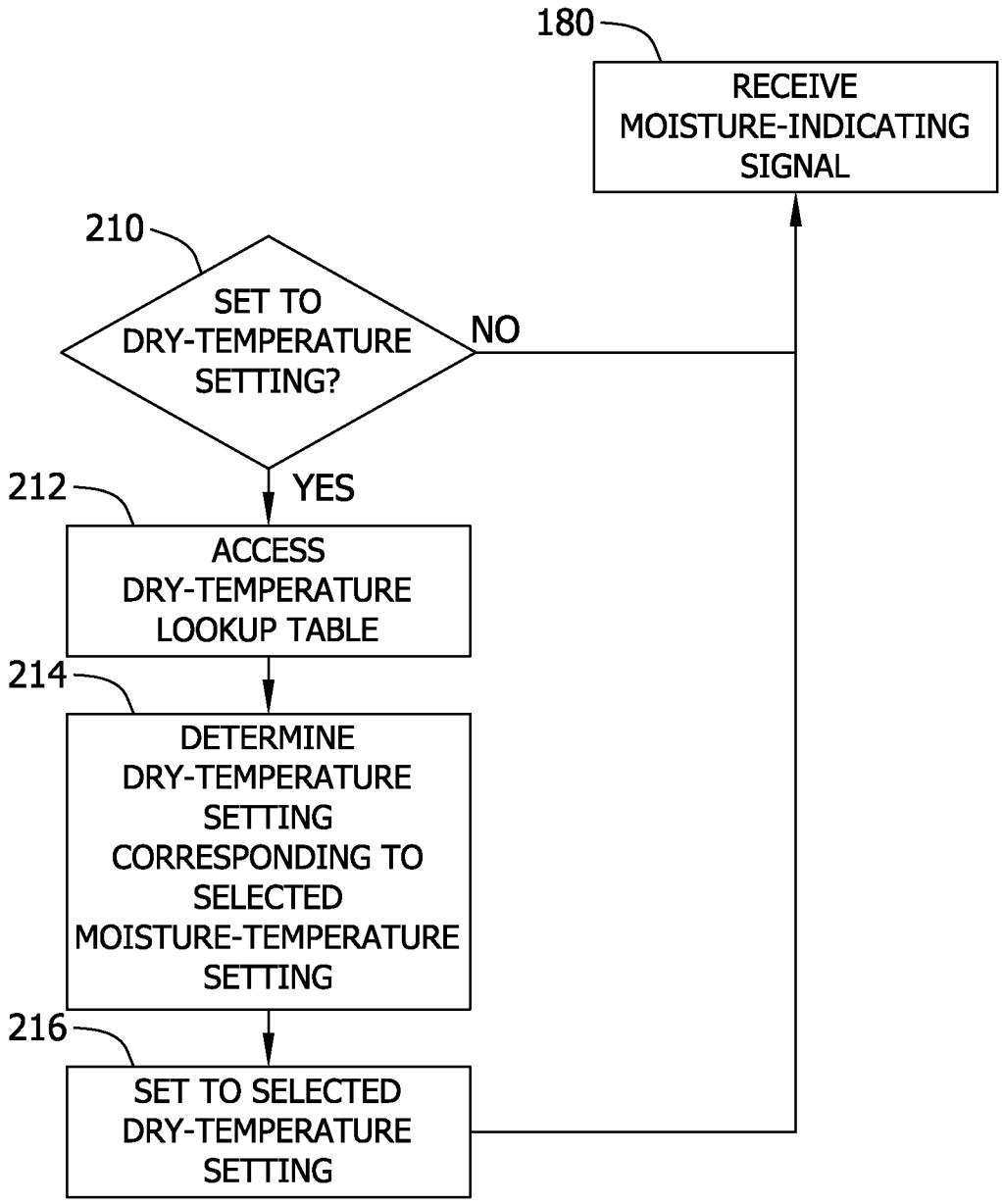
FIG. 12 is a flowchart representing a second example of an operation performed by the control circuit of the hair styling apparatus for setting the heating member assembly to a dry-temperature setting.

In another example illustrated schematically in FIG. 12, the step 196 of setting the hair styling apparatus 101 to the dry-temperature setting includes the step 210 of first determining if the heating members 111 are already set to the dry-temperature setting, and if so, the control circuit will proceed to the step 180. If the hair styling apparatus 101 is not already set to the dry-temperature setting, then at step 212 the control circuit 110 accesses a dry-temperature lookup table, for example, and selects, at step 214, a dry-temperature setting, from a plurality of dry-temperature setting, corresponding to the selected moisture-temperature setting. At step 216, the control circuit 110 sets the hair-styling apparatus 101 to the selected dry-temperature setting. For example, the hair styling apparatus 101 may include a computer-readable memory (EPROM) including a lookup table that is accessible by the control circuit 101. Two exemplary lookup tables are provided below as Table 1 and Table 2, respectively.

TABLE 1

| Exemplary Lookup Table for Processor | |
|---|---|
| Moisture-Temperature Setting (° C.) | Dry-Temperature Setting (° C.) |
| 235 | 190 |
| 220 | 190 |
| 200 | 190 |

TABLE 1-continued

| Exemplary Lookup Table for Processor | |
|---|---|
| Moisture-Temperature Setting (° C.) | Dry-Temperature Setting (° C.) |
| 180 | 170 |
| 160 | 150 |

TABLE 2

| Exemplary Lookup Table for Processor | |
|---|---|
| Moisture-Temperature Setting (° C.) | Dry-Temperature Setting (° C.) |
| 230 | 190 |
| 210 | 190 |
| 190 | 180 |
| 170 | 160 |
| 150 | 140 |

As can be seen from the above exemplary Tables 1 and 2, in this embodiment the dry-temperature setting has a temperature that is less than the corresponding moisture-temperature setting. Thus, the control circuit will lower the temperature of the heating member regardless of the temperature of the moisture-temperature setting. Other ways of configuring or programming the control circuit 110 such that the control circuit adjusts the temperature of the dry-temperature setting based on the selected moisture-temperature setting do not depart from the scope of the present invention.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A hair styling apparatus comprising:

a hair-heating device for applying heat to hair, the hair-heating device being operable in a moisture-temperature setting and a dry-temperature setting less than the moisture-temperature setting, the hair-heating device having a heating unit and a contact surface for contact with the hair being heated;

first and second arms secured to one another for selective movement toward one another to configure the hair styling apparatus between an open position and a closed position, the hair-heating device disposed on at least one of the first and second arms;

a moisture sensor comprising a pair of elongate electrodes extending lengthwise on the contact surface for making electrical contact with the hair, said moisture sensor adapted to detect a moisture-indicating parameter of the hair via said electrodes, and generate a moisture-indicating signal indicative of whether the hair is at or below a predetermined moisture threshold level; and a control circuit in operative communication with the hair-heating device and the moisture sensor, the control circuit being configured to adjust the temperature of the hair-heating device from the moisture-temperature setting to the dry-temperature setting in response to the moisture sensor generating a moisture-indicating signal indicative of the hair being at or below the predetermined moisture threshold level, wherein the heating unit is active in the dry-temperature setting, the control circuit being configured to set the hair-heating device to the moisture-temperature setting when the hair styling apparatus is in the open position.

2. The hair styling apparatus set forth in claim 1 wherein the dry-temperature setting is less than or equal to about 210° C., and wherein the moisture-temperature setting is greater than 210° C.

3. The hair styling apparatus set forth in claim 1 wherein one of the following conditions is met:

the dry-temperature setting is less than or equal to about 200° C., and wherein the moisture-temperature setting is greater than 200° C.;

the dry-temperature setting is less than or equal to about 195° C., and wherein the moisture-temperature setting is greater than 195° C.; and the dry-temperature setting is less than or equal to about 190° C., and wherein the moisture-temperature setting is greater than 190° C.

4. The hair styling apparatus set forth in claim 1 wherein the hair-heating device includes a heating member having a length, the electrodes extending along a majority of the length of the heating member.

5. The hair styling apparatus set forth in claim 1 wherein the hair-heating device includes a heating member having a hair-heating surface, the heating member defining a generally t-shaped recess in the hair-heating surface such that the electrodes are disposed in the recess.

6. The hair styling apparatus set forth in claim 1 wherein the hair-heating device includes a heating member having a pair of longer sides and a pair of shorter sides, the electrodes being disposed between the longer sides of the heating member.

7. The hair styling apparatus set forth in claim 1 further comprising an open/closed switch for detecting when the hair styling apparatus is in the open position, wherein when the hair-heating device is set to the dry-temperature setting, the control circuit is configured to set the hair-heating device to the moisture-temperature setting in response to the hair styling apparatus being in the open position.

8. The hair styling apparatus set forth in claim 7 wherein the control circuit is further configured to adjust the hair-heating device from the moisture-temperature setting to the dry-temperature setting only if the hair styling apparatus is in the closed position.

9. The hair styling apparatus set forth in claim 1 wherein the hair styling apparatus comprises a control to facilitate selective enabling and disabling of the control circuit adjustment of the temperature of the hair-heating device from the moisture-temperature setting to the dry-temperature setting.

10. A method of styling hair using a hair styling apparatus comprising:

heating a hair-heating device of the hair styling apparatus to a moisture-temperature setting;

applying heat to the hair using the hair-heating device;

determining, using a moisture sensor that makes electrical contact with the hair and a control circuit of the hair styling apparatus, that the hair is at or below a predetermined moisture threshold level;

decreasing the temperature of the hair-heating device, using the control circuit, from the moisture-temperature setting to a dry-temperature setting in response to said determining that the hair is at or below the predetermined moisture threshold level, wherein the hair-heating device is active in the dry-temperature setting;

opening said hair styling apparatus; and automatically increasing the temperature of the hair-heating device, using the control circuit, from the dry-temperature setting to the moisture-temperature setting in response to said opening of said hair styling apparatus.

11. The method set forth in claim 10 wherein the temperature in the dry-temperature setting is less than or equal to about 210° C.

12. The method set forth in claim 10 wherein the temperature in the dry-temperature setting is less than or equal to about 200° C.

13. The method set forth in claim 10 wherein the temperature in the dry-temperature setting is less than or equal to about 195° C.

14. The method set forth in claim 10 wherein the temperature in the dry-temperature setting is less than or equal to about 190° C.

15. The method set forth in claim 10 wherein the temperature in the dry-temperature setting is from about 160° C. to about 200° C.

16. The method set forth in claim 10 wherein the temperature in the dry-temperature setting is from about 165° C. to about 195° C.

17. The method set forth in claim 10 wherein the temperature in the dry-temperature setting is from about 170° C. to about 190° C.

18. A hair styling apparatus comprising:

first and second arms secured to one another for selective movement toward one another to configure the hair styling apparatus between an open position and a closed position;

a hair-heating device on the first arm, the hair-heating device being operable in a moisture-temperature setting and a dry-temperature setting less than the moisture-temperature setting, the hair-heating device including:

a thermally conductive heating member having an imaginary axis and a hair-heating surface in generally opposing relationship with the second arm, the heating member defining a recess in the hair-heating surface extending generally axially along the heating member, and a heating unit in thermal contact with the heating member, wherein the heating unit is adapted for selectively heating the heating member to a temperature sufficient to evaporate moisture in hair when the hair is disposed between the hair-heating surface and the second arm and when the hair styling apparatus is configured in the closed position, the heating unit being active in the dry-temperature setting;

a moisture sensor adapted for making electrical contact with the hair to produce a moisture-indicating signal indicative of whether hair disposed between the hair-heating surface and the second arm is at or below a predetermined moisture threshold level, the moisture sensor including an electrode assembly disposed in the recess of the first arm, the electrode assembly including a pair of elongate, spaced-apart electrodes extending axially on the hair-heating surface; and a control circuit in electrical communication with the moisture sensor, the control circuit being configured to receive the moisture-indicating signal from the moisture sensor and determine whether the hair is at or below the predetermined moisture threshold level using the moisture-indicating signal, the control circuit being configured to set the hair-heating device to the moisture-temperature setting when the hair styling apparatus is in the open position.

19. The hair styling apparatus of claim 18 wherein the electrodes are disposed below the hair-heating surface of the heating member.

20. The hair styling apparatus of claim 19 wherein the electrode assembly further includes an electrical insulator in the recess disposed between the electrodes and the heating member to electrically insulate the electrodes from the heating member.

21. The hair styling apparatus of claim 20 wherein the electrical insulator is disposed below the hair-heating surface of the heating member.

22. The hair styling apparatus of claim 20 wherein the electrodes are embedded in the electrical insulator and have exposed hair-contact peripheral portions for contacting hair when the hair is disposed between the hair-heating surface and the second arm.

* * * * *